US007321746B2

(12) United States Patent
Sakakibara et al.

(10) Patent No.: US 7,321,746 B2
(45) Date of Patent: Jan. 22, 2008

(54) IMAGE HEATING APPARATUS AND PRESSURE ROLLER USED IN THE APPARATUS

(75) Inventors: Hiroyuki Sakakibara, Mishima (JP); Osamu Sotome, Numazu (JP); Tomoyuki Makihira, Ashigara-gun (JP); Shizuma Nishimura, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 11/082,858

(22) Filed: Mar. 18, 2005

(65) Prior Publication Data

US 2005/0214044 A1 Sep. 29, 2005

(30) Foreign Application Priority Data

Mar. 24, 2004 (JP) ..... 2004-087747

(51) Int. Cl.
*G03G 15/20* (2006.01)

(52) U.S. Cl. ..... 399/333

(58) Field of Classification Search ..... 399/333; 219/216

See application file for complete search history.

(56) References Cited

U.S. PATENT DOCUMENTS

| | | | | |
|---|---|---|---|---|
| 5,210,579 | A | 5/1993 | Setoriyama et al. | 399/338 |
| 5,525,775 | A | 6/1996 | Setoriyama et al. | 219/216 |
| 6,002,910 | A | 12/1999 | Eddy et al. | 399/329 |
| 6,108,906 | A * | 8/2000 | Fujita et al. | 29/895.211 |
| 6,438,348 | B2 | 8/2002 | Kobaru et al. | 399/333 |
| 6,516,165 | B2 | 2/2003 | Makihira et al. | 399/69 |
| 6,516,166 | B2 | 2/2003 | Sakakibara et al. | 399/69 |
| 6,587,662 | B2 | 7/2003 | Kobaru et al. | 399/323 |
| 6,704,537 | B2 * | 3/2004 | Takeuchi et al. | 399/328 |
| 6,734,397 | B2 | 5/2004 | Kato et al. | 219/216 |
| 2002/0114649 | A1 * | 8/2002 | Ohuchi | 399/286 |
| 2004/0132597 | A1 | 7/2004 | Sakakibara et al. | 492/56 |
| 2004/0202491 | A1 | 10/2004 | Sakai et al. | 399/69 |

FOREIGN PATENT DOCUMENTS

| | | |
|---|---|---|
| JP | 4-44075 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 05286056 A * | 11/1993 |
| JP | 11-116806 | 4/1999 |
| JP | 11-158377 | 6/1999 |
| JP | 2000-39789 | 2/2000 |
| JP | 2002-268423 | 9/2002 |
| JP | 2002-351243 | 12/2002 |
| JP | 2003-208052 | 7/2003 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image heating apparatus for heating an image formed on a recording material includes a heating device which heats the image formed on the recording material, and a pressure roller which forms a nip portion in cooperation with the heating device, with the recording material being conveyed in the nip portion. The pressure roller has a heat resistive rubber in which acicular fillers with a thermal conductivity of more than 300 W/mK are dispersed in a rate of 12 to 26 volume percentage. An image heating apparatus is achieved which prevents increasing the temperature at the area through which a recording material does not pass.

15 Claims, 3 Drawing Sheets

IMAGE HEATING APPARATUS AND PRESSURE ROLLER USED IN THE APPARATUS

BACKGROUND OF THE INVENTION

1. Field of the Invention

The present invention relates to an image heating apparatus which is suitable for a heat fixing device mounted in a copying machine or a printer, and to a pressure roller used in the apparatus.

2. Description of the Related Art

On an electrophotographic copying machine or printer, a fixing device is mounted which heats and fixes toner images formed on a recording material. There are various types of heat fixing devices including: a heat roller type which heats and fixes an image while sandwiching and transporting a recording material by a fixing roller heated by a halogen heater provided therein and a pressure roller; an on-demand type (also called a film-heating type) which contacts a ceramic heater with the inner surface of a flexible sleeve (a fixing film or a fixing belt) basically made of a heat resistant resin and a metal and heats a recording material through the flexible sleeve; and an electromagnetic induction heating type in which a rotor itself to be contacting with the recording material generates heat.

When a small size of paper is continuously printed with an image-forming device mounting such a heat fixing device, there occurs a phenomenon of slowly increasing the temperature at the area of a fixing nip portion in a longitudinal direction, through which the paper does not pass (temperature rise in a no-paper-passing area). If the temperature of the no-paper-passing area is too high, it causes damage in each part of the apparatus, and when a large size of paper is printed in a temperature risen state in the no-paper-passing area, it causes a high-temperature offset in the region corresponding to the area through which a small size of paper has not passed.

Particularly, a film-heating type capable of employing a heating body with a low heat capacity has a smaller heat capacity of the heating body than that in a heat roller type, so that it causes a higher temperature rise in a no-paper-passing part of the heating body, and easily causes the degradation of durability, a high-temperature offset and problems such as the instability of film driving and the fold of a film.

In addition, as an image-forming device has a higher processing speed, it causes a temperature rise more often in the no-paper-passing area. That is, as long as a period of time when a recording material passes through a fixing nip portion becomes shorter with an increasing speed, it is inevitable to increase a heat fixing temperature. Also, as long as a period of time when a recording material does not exist in a fixing nip portion (so-called an empty period between sheets of paper) in a continuous printing step is decreased with the increasing speed of an apparatus, it is difficult to uniform the temperature distribution during the interval between sheets of paper.

As one of means for decreasing a temperature rise in a no-paper-passing part, a technique of increasing the thermal conductivity of a pressure roller is generally known. The means aims the lowering of the temperature in the no-paper-passing part through positively improving the thermal conductivity of an elastic layer of the pressure roller, or equivalently, the effect of decreasing the difference of temperature among areas in a longitudinal direction.

For instance, Japanese Patent Application Laid-Open No. H11-116806, H11-158377 and 2003-208052 disclose a method of adding a highly heat conductive filler such as alumina, zinc oxide and silicon carbide to a base rubber for the elastic layer of a fixing roller and a pressure roller, in order to enhance the thermal conductivity of them.

In addition, Japanese Patent Application Laid-Open No. 2002-268423 discloses a method of making an elastic layer of a rotor (which is not a pressure roller but a fixing belt) having the elastic layer contain carbon fiber to enhance thermal conduction, and Japanese Patent Application Laid-Open No. 2000-39789 discloses a method of making the elastomer layer contain an anisotropic filler such as graphite to enhance the thermal conductivity in a roller thickness direction. In addition, Japanese Patent Application Laid-Open No. 2002-351243 discloses an invention of arranging the layer of woven fabric using pitch-based carbon fiber in the elastic layer of a pressure roller.

However, even if a filler such as alumina, zinc oxide, silicon carbide, carbon fiber and graphite as described in Japanese Patent Application Laid-Open No. H11-116806, Japanese Patent Application Laid-Open No. H11-158377, Japanese Patent Application Laid-Open No. 2003-208052, Japanese Patent Application Laid-Open No. 2002-268423 and Japanese Patent Application Laid-Open No. 2000-39789 is added to an elastic layer for the purpose of increasing the thermal conductivity, a small amount of the addition can not provides a desired thermal conductivity, and a large amount of the addition causes a problem that a pressure roller becomes too hard to provide a sufficient nip for a toner-fixing process. In addition, when the hardness of a base rubber of forming an elastic layer is lowered so as to lower the hardness of the pressure roller while adding a large amount of the filler, the durability performance of the rubber becomes insufficient. Thus, it has been very difficult to balance high heat conduction with low hardness while keeping the durability performance of the pressure roller.

On the other hand, a pressure roller disclosed in Japanese Patent Application Laid-Open No. 2002-351243 has a very superior thermal conductivity. However, even the pressure roller has high hardness because of woven fabric contained in an elastic layer, and also very hardly balances high heat conduction with low hardness.

SUMMARY OF THE INVENTION

The present invention has been accomplished with respect to the above described problems, and is directed at providing an image heating apparatus which controls the temperature rise at the area through which a recording material does not pass, and providing a pressure roller used in the apparatus.

Another object of the present invention is to provide a pressure roller with high thermal conductivity and low hardness.

A further object of the present invention is to provide a pressure roller with high durability, high thermal conductivity and low hardness.

Still another object of the present invention is to provide an image heating apparatus for heating an image formed on a recording material, comprising:

heating means for heating the image formed on the recording material;

a pressure roller for forming a nip portion in cooperation with said heating means, the recording material is conveyed in the nip portion;

wherein said pressure roller has a heat resistive rubber layer in which acicular fillers with a thermal conductivity of 300 W/mK or higher are dispersed in a rate of 12 to 26 volume percentage.

Still another object of the present invention is to provide a pressure roller comprising:

a core metal;

a heat resistive rubber layer;

wherein said heat resistive rubber layer contains acicular fillers with a thermal conductivity of 300 W/mK or higher dispersed in a rate of 12 to 26 volume percentage.

Still another object of the present invention is to provide an image heating apparatus for heating an image formed on a recording material, comprising:

heating means for heating an image formed on a recording material;

a pressure roller for forming a nip portion in cooperation with said heating means, the recording material is conveyed in the nip portion;

wherein said pressure roller has a thermal conductivity of 0.5 W/mK or higher and an Asker C hardness of 65 degrees or lower.

Still another object of the present invention is to provide a pressure roller comprising:

a core metal;

a heat resistive rubber layer;

wherein said pressure roller has a thermal conductivity of 0.5 W/mK or higher and an Asker C hardness of 65 degrees or lower.

A further object of the present invention will become apparent when the following details will be read with reference to the accompanying drawings.

DETAILED DESCRIPTION OF THE PREFERRED EMBODIMENTS

Embodiment 1

(1) Example of Image-forming Device

Figure 1:
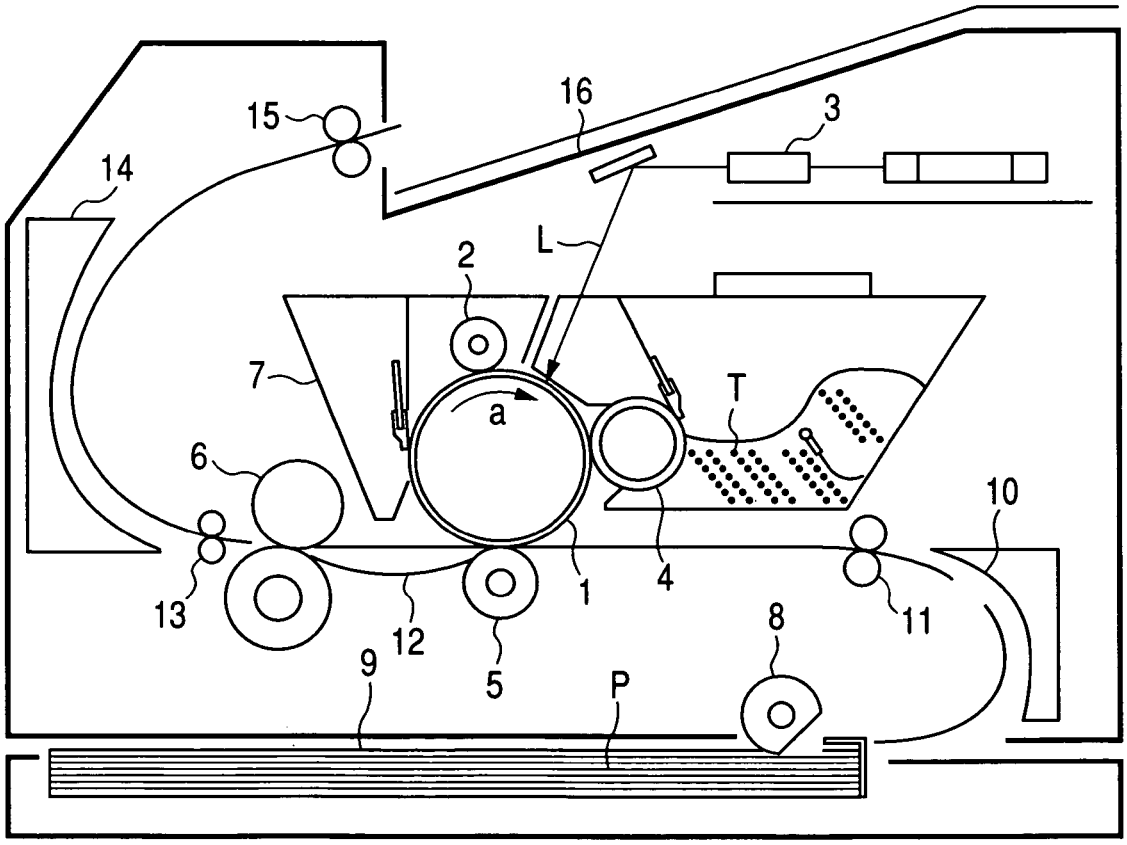
FIG. 1 is a schematic block diagram of an image-forming device.

FIG. 1 is a schematic block diagram of one example of an image-forming device. An image-forming device according to the present example is a laser-beam printer using a transferring electrophotographic process.

Reference numeral 1 denotes a rotatable drum type photoreceptor as an image carrier for electrophotography (hereafter called a photoconductor drum), which is rotationally driven at predetermined peripheral velocity (a process speed) clockwise as shown by an arrow (a). The photoconductor drum 1 has a structure of having a photosensitive material layer such as OPC, amorphous Se and amorphous Si formed on the outer circumferential surface of a cylindrical (a drum-shaped) electroconductive substrate made from aluminum, nickel or the like.

The photoconductor drum 1 is uniformly electrostatically charged into a predetermined polarity or an electric potential by an electrostatically charging roller 2 of means for electrostatically charging the drum in the rotation process. The uniformly electrostatically charged surface of the rotation photoconductor drum 1 is exposed to a scanning laser beam (L) which is output from a laser beam scanner 3 and has been modulation-controlled (ON/OFF control) according to image information, and thereby has an electrostatic latent image of objective image information formed on the rotation surface of the photoconductor drum.

A formed latent image is developed with a developing device 4 by a toner T to be visualized. A jumping development method, a two-component development method and a feed development method are used for the development method, and a combination of image exposure and reversal development is often used.

Meanwhile, recording materials P accommodated in a paper feeding cassette 9 are paid off one by one by driving by a paper feeding roller 8, are fed to a transfer nip portion which is the pressure-contacted part of a photoconductor drum 1 with a transfer roller 5, through a sheet path having a guide 10 and a resisting roller 11, at desirably controlled timing, and have a toner image which has existed on a photoconductor drum surface, sequentially copied on the surfaces of the fed recording materials P.

The recording material fed from the transfer nip portion is sequentially separated from the rotation surface of a photoconductor drum 1, is introduced into a heat fixing device 6 of a heating device though a conveying device 12, and has a toner image heat-fixed thereon. A heat fixing device 6 will be described in detail in the following section (2).

The recording material P fed from a heat fixing device 6 passes through a sheet path formed of a transportation roller 13, a guide 14 and an eject roller 15, and is printed out into a paper exit tray 16.

Meanwhile, a rotation surface of a photoconductor drum is cleaned though the treatment of removing deposited contaminants such as a remaining transferred toner with a cleaning unit 7 after a recording material has been separated, and is repeatedly made available for image formation.

In the present preferred embodiment, an image-forming device corresponding to an A3 size of paper was used, which has a printing speed of 35 sheets/minute (a sideways move of the A4 size), the first printing time of 10 sec, and a period of 6 seconds after a printing signal has been input and before a sheet of paper enters a fixing nip portion. In addition, a used toner T contained a styrene acryl resin as a main material, and a charge control agent, a magnetic substance and silica, which are inner-added and outer-added as needed thereto, and had a glass transition point of 55 to 65° C.

(2) Heat Fixing Device (Image Heating Apparatus) 6

Figure 2:
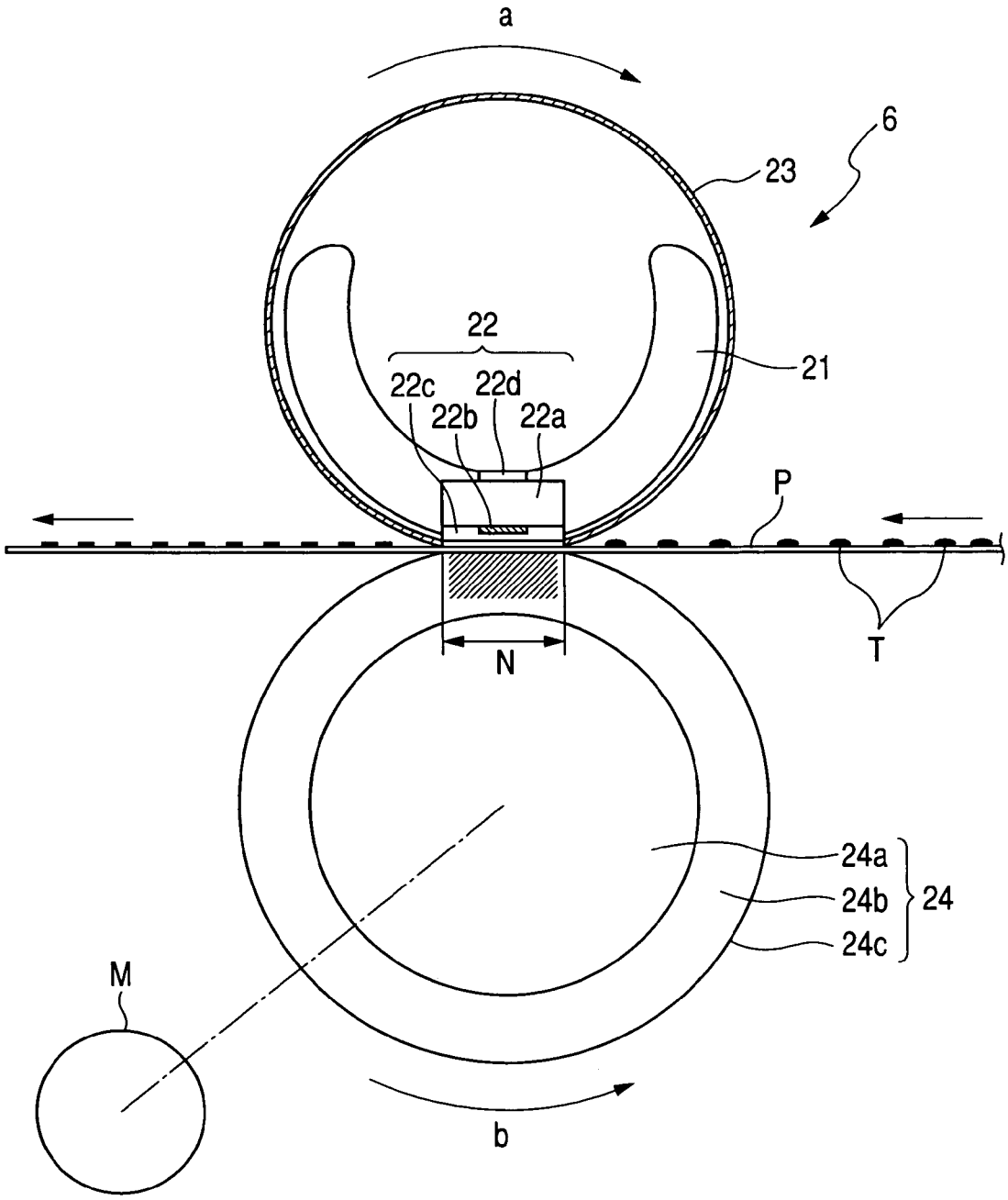
FIG. 2 is a schematic block diagram of a heat fixing device.

FIG. 2 is a schematic diagram of a heat fixing device 6 as an image heating apparatus used in the present embodiment. A heat fixing device 6 according to the present embodiment is a heating device of a so-called film-heating type/pressure rotor (pressure roller) driving type of a tensionless type, which is described in Japanese Patent Application Laid-Open No. H04-44075 to H04-44083, Japanese Patent Application Laid-Open No. H04-204980 to H04-204984 and the like.

Reference numeral 21 denotes an oblong film guide member (a stay) which has a transverse section of an approximately semicircular/a flume shape and makes a vertical direction for the drawing longitudinal; reference numeral 22 denotes an oblong heating body (a heater) which is accommodated in and held by a groove longitudinally formed in the approximately central part of the undersurface of the film guide member 21; and reference numeral 23 denotes a heat resistive film (a flexible sleeve) of an endless-belt-shape (a cylindrical shape), which is loosely outwardly-engaged in the film guide member 21 provided with the heating body. These reference numerals 21 to 23 compose heating means according to the present embodiment.

Reference numeral 24 denotes an elastic pressure roller of a pressurizing member, which is pressure-contacted to the undersurface of a heating body 22 so as to sandwich a film 23 between them. Reference character N is a pressure-contacted nip portion (a fixing nip portion) formed in between the heating body 22 and an elastic layer 24*b* of a pressure roller 24 which is pressure-contacted with the heating body 22 while sandwiching the film 23, as a result of the elastic deformation of the elastic layer 24*b*. The pressure roller 24 is rotationally driven in a counterclockwise direction as shown by the arrow (b) at predetermined peripheral velocity by a driving force which has been transmitted from a driving source M through a power transmission system such as a gear not shown in the drawing.

A film guide member 21 is a molded article made of a heat resistive resin such as PPS (polyphenylene sulfite) and a liquid crystal polymer, for instance.

In the present embodiment, a heating body 22 is a ceramic heater with a low heat capacity as a whole, which comprises: an oblong/thin plate heater substrate 22*a* made from alumina or the like; an electrification heating element (a resistance heating element) 22*b* which is longitudinally formed on the surface side (a film sliding side) of the heater substrate 22*a*, and is made of a shape of a line or a ribbon of Ag/Pb or the like; a thin surface protective layer 22C such as a glass layer; and a temperature-sensing element 22*d* such as a thermistor, which is arranged on the back side of the heater substrate 22*a*. The ceramic heater 22 quickly raises the temperature when an electric power is supplied to the electrification heating element 22*b*, and is controlled by a power control system including the temperature-sensing element 22*d* so as to keep a predetermined fixing temperature (a control temperature).

A heat resistive film 23 is a single-layer film which has a thickness of 100 μm or thinner and preferably 60 μm to 20 μm in total so as to improve the quick start properties of an apparatus by reducing its heat capacity, and is made from PTFE (polytetrafluoroethylene), PFA(tetrafluoroethylene perfluoroalkyl vinyl ether), PPS or the like, having heat resistance, mold release characteristics, strength and durability; or a composite layered film having a releasing layer made from PTFE, PFA and FEP (tetrafluoroethylene perfluoroalkyl vinyl ether) coated on the surface of a base film made from polyimide, polyamide-imide, PEEK (polyetheretherketone), PES (polyethersulfone) or the like.

A pressure roller 24 comprises a core metal 24*a* made of a material such as iron and aluminum, and an elastic layer 24*b* obtained from a material and through a manufacturing method, which will described in detail in the following section (3).

Because a pressure roller 24 is rotationally driven in the counterclockwise direction of the arrow (b) at least when an image is being formed, a film 23 is also rotated according to the rotation of the pressure roller 24. In other words, when a pressure roller is driven, the film 23 receives a rotating force caused by a frictional force working between the pressure roller 24 and the outer surface of the film 23, at a pressure-contacted nip portion N. When a film rotates, the inner surface of the film slides in a pressure-contacted nip portion N while tightly contacting with the undersurface of a heating body 22. For the operation, it is recommended to place a lubricant such as heat resistive grease between them so as to reduce a sliding friction between the inner surface of a film 23 and the undersurface of the heating body, under which the film 23 slides.

While a recording material is nipped and transported in a nip portion N, a toner image on the recording material is heated and fixed. The recording material P having passed through the pressure-contacted nip portion N is separated from the outer surface of a film 23 and is transported.

An apparatus 6 of a film-heating type as in the present embodiment can employ a heating body 22 having a low heat capacity and a rapid temperature-raising speed, and can greatly shorten a period before the heating body 22 reaches a predetermined temperature. The apparatus 6 can be easily started up because of a rapid temperature rise from ordinary temperature to a high temperature, so that it does not need to be temperature controlled for start in a stand-by state of printing none and saves an electric power.

In addition, a rotating film 23 does not substantially receive a tensional force at other parts than a pressure-contacted nip portion N, so that the apparatus 6 arranges only a flange member for simply receiving the end of the film 23 as regulating means for unbalancing or moving of the film.

(3) Pressure Roller 24

The materials of composing a pressure roller 24 of a pressurizing member in the above described heat fixing device 6 and a method for forming it will be now described in detail below.

3-1) Layer Structure of Pressure Roller 24

Figure 3:
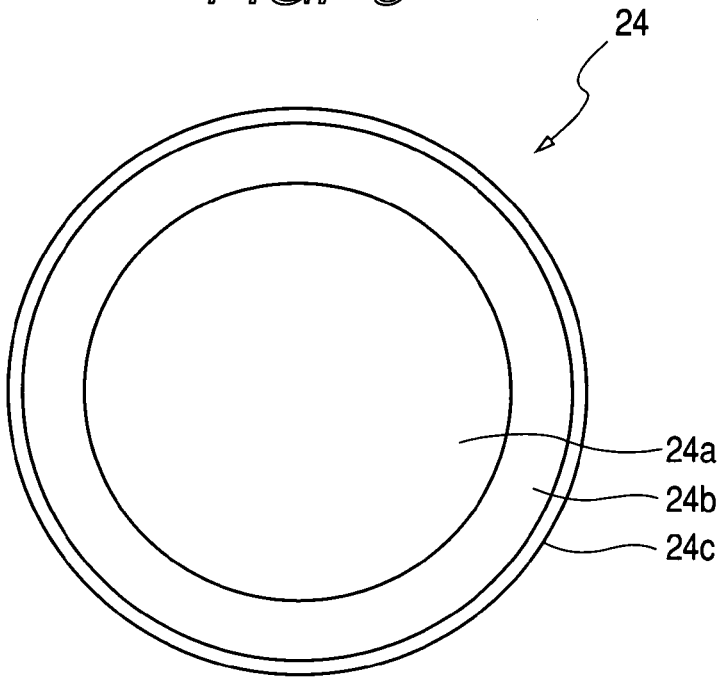
FIG. 3 is a schematic diagram of a layer structure of a heating roller.

FIG. 3 is a schematic drawing of a layer structure of a pressure roller 24. The pressure roller 24 has at least (a): an elastic layer 24*b* (a heat resistive rubber layer) formed of a flexible and heat resistive material typically like silicone rubber, and (b): a releasing layer 24*c* made of a suitable material for the surface of the pressure roller typically like a fluororesin or fluorine-containing rubber, layered on at least the outer surface of a core metal 24*a*.

The thermal conductivity of a pressure roller 24 according to the present invention was measured by pressing a probe (PD-13, a product made by Kyoto Electronics Manufacturing Co., Ltd.) against a pressure roller surface so that the probe sufficiently can contact with the roller, with the use of a quick thermal conductivity meter (QTM-500, a product made by Kyoto Electronics Manufacturing Co., Ltd.). In addition, the pressure roller to be measured had been left at the room temperature of 23° C. for 30 minutes or longer, and the thermal conductivity was measured in the same environment of the room temperature of 23° C.

According to a research work by the present inventors, temperature rise in a no-paper-passing part can be alleviated by controlling the thermal conductivity of a pressure roller to 0.5 W/mK or higher, and consequently the degradation of the durability of the pressure roller 24 and a high-temperature offset can be prevented. By controlling the thermal conductivity of the pressure roller 24 further preferably to 0.8 W/mK or higher, the temperature rise in the no-paper-passing part can be lowered even if a process speed is increased or a fixing temperature is raised, and consequently high-speed fixing is enabled without such a lowering of capacity as a lowering of fixability and reduction in the sheet number of passing paper.

The upper limit of the thermal conductivity of a pressure roller 24 is not limited in the present invention in particular, but a thermal conductivity of 2 W/mK or lower is thought to be preferable considering that the pressure roller made of one elastic layer is practically used.

However, as described above, it is meaningless to improve the thermal conductivity of a pressure roller while sacrificing the hardness of the pressure roller. It is necessary to improve the thermal conductivity of the pressure roller while controlling the hardness increase of the pressure roller.

The roller hardness Hs (Asker C) of a pressure roller 24 which is a pressurizing member according to the present invention was measured at the room temperature of 23° C. while pressing an Asker C sclerometer (a product made by Kobunshi Keiki Co., Ltd.) against a pressure roller surface with the load of 9.8 N(1 kgf).

According to a research work of the present inventors, by adjusting the roller hardness Hs of a pressure roller 24 to 65 degrees or lower, the pressure-contacted nip portion N which is formed in between a film guide member 21 and a pressure roller 24 through a film 23, can be secured into a practical range. When the pressure roller hardness is 65 degrees or higher, a pressurizing force for securing a necessary nip width becomes very high, unfavorably damage or wearing in each component occurs, and the expansion of an apparatus becomes necessary for the purpose of strengthening the components in order to preventing them. By controlling Hs to further preferably 60 degrees or lower, the pressurizing force necessary for securing a nip width N can be reduced, and because the nip width N can be increased if a pressure-contacted force is the same, an adequate fixability of a toner can be secured even if the control temperature of a heater is lowered. The lower limit of the roller hardness Hs of the pressure roller 24 is not limited in the present invention in particular, but a value of 30 degrees or higher is thought to be preferable in consideration of durability needed in the uses of a practical pressure roller 24.

In summary, it is understood that a pressure roller has preferably a thermal conductivity of 0.5 W/mK or higher and a hardness (Asker C) of 65 degrees or lower.

3-1-1) Elastic Layer (Heat Resistive Rubber Layer) 24*b*

An elastic layer 24*b* will be described which is a unique point of the present invention. The thickness of the elastic layer 24*b* used in a pressure roller 24 is not particularly limited, as long as being capable of forming a desired width of a pressure-contacted nip portion N, but is preferably 2 to 10 mm. In addition, the elastic layers 24*b* may be formed of a plurality of layer unless going beyond the features of the present invention.

An elastic layer 24*b* has acicular fillers 24*d* with a thermal conductivity λ of 300 W/mK or higher dispersed therein to perform the peculiarity of a pressure roller 24 as a pressurizing member according to the present invention. The acicular fillers 24*d* has acicular shaped components. The thermal conductivity λ at this time can be determined with a general optical alternating current method.

Figure 4:
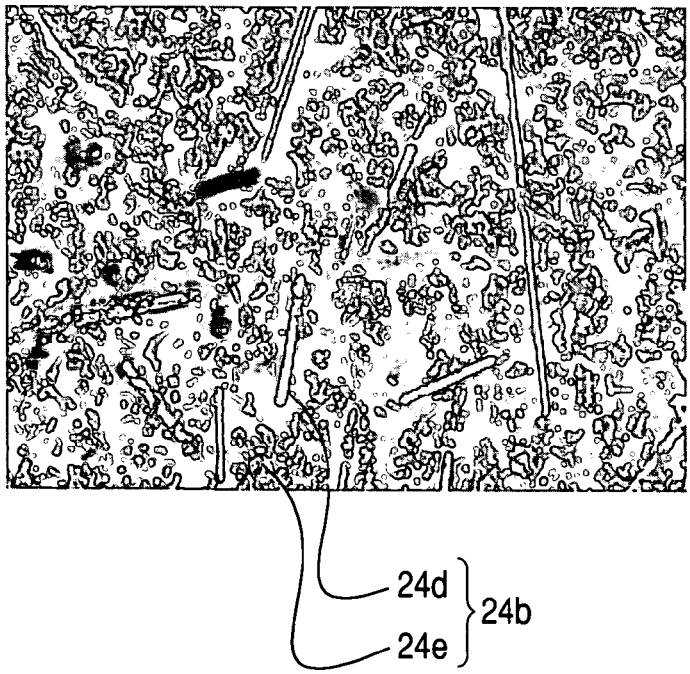
FIG. 4 is a macrophotograph of the surface of a silicone rubber layer in the state of having silicone rubber formed on a core metal (in the state of not being coated with a releasing layer), which shows the dispersed state of pitch-based carbon fiber.

Taking an example for a more specific shape of the acicular filler, an average length of a minor axis (equivalently a diameter) is 5 to 11 μm and an average length of a major axis is about 100 to 500 μm. In addition, taking an example for a specific material of such an acicular filler, there is pitch-based carbon fiber which is industrially easily available. A macrophotograph of the surface of an elastic layer 24*b* is shown in FIG. 4, which has acicular fillers 24*d* dispersed in such a flexible material 24*e* with heat resistance typically as silicone rubber for an example.

The lower limit of the content of a filler 24*d* in an elastic layer is 12 vol. % in the present invention, and when the content is lower than the value, the elastic layer does not show an expected thermal conduction value. In addition, the upper limit of the content is 26 vol. %. When the content is higher than the value, the elastic layer does not show an expected hardness.

In addition, in order to obtain a pressure roller having a thermal conductivity of 0.5 W/mK or higher and a hardness (Asker C) of 65 degrees or lower, the acicular fillers have only to be dispersed in a heat resistive rubber layer in as an acicular state without being formed into the shape of woven fabric or non-woven fabric. Then, the directions of the acicular fillers in the heat resistive rubber layer may be random or uniform (oriented). In addition, a manufacturing method for obtaining the heat resistive rubber layer is not limited in particular. Preferred methods are, for instance, a casting method, an extrusion method, and a coating method with the use of a rim gate. Any manufacturing method can make the directions of acicular fillers dispersed in a rubber layer random, or oriented into one direction. Factors for controlling the orientation of the acicular fillers mainly include a major/minor axis ratio of an acicular filler, the thickness of an elastic layer, the viscosity of a base rubber, and the speed (shear force) of casting or extrusion. Particularly when the major/minor ratio is high, the elastic layer is thin, the viscosity is low and the shear force is high, the acicular fillers tend to be oriented.

In the present invention, an elastic layer 24*b* may contain a filler, a load material and a compounding ingredient, which are not described in the present invention, as means for solving publicly known problems, unless they exceed the range of the features of the invention.

3-1-2) Releasing Layer 24*c*

A releasing layer 24*c* may be formed by covering an elastic layer 24*b* with a PFA tube, or may be formed by coating the elastic layer with a fluorine-containing rubber or a fluororesin such as PTFE, PFA and FEP. In addition, the thickness of the releasing layer 24*c* is not limited in particular as long as being capable of imparting adequate mold releasing properties to a pressure roller 24, but is preferably 20 to 50 μm.

3-2) Method for Manufacturing Pressure Roller 24

A method for manufacturing the above described pressure roller 24 will be described.

3-2-1) First of all, a base polymer to be used is preferably liquid silicone rubber having heat resistance and superior workability.

A liquid silicone rubber material has only to present a liquid state at ordinary temperature and become silicone rubber having rubbery elasticity when hardened by heat, and the type or the like is not limited in particular.

Such a liquid silicone rubber material includes: an addition reaction curing type of a liquid silicone rubber composition which comprises a diorganopolysiloxane containing an alkenyl group, an organohydrogenpolysiloxane containing silicon-atom-bonded hydrogen, and a strengthening filler, and which is cured by a platinum-based catalyzer into silicone-rubber; an organic peroxide curing type of a silicone rubber composition which comprises a diorganopolysiloxane containing an alkenyl group and a strengthening filler, and which is cured by an organic peroxide into silicone rubber; and a condensation reaction curing type of a liquid silicone rubber composition which comprises a diorganopolysiloxane containing a hydroxyl group, an organohydrogenpolysiloxane containing a silicon-atom-bonded hydrogen atom, and a strengthening filler, and which is cured by a condensation reaction accelerating catalyst such as an organotin compound, an organotitanium compound and a platinum-based catalyzer, into silicone rubber.

Among them, an additive reaction curing type of the liquid silicone rubber material is preferable because of having a high curing rate and a superior curing uniformity.

In order to obtain a cured substance as a rubbery elastic body, it is preferable to employ such a liquid silicone rubber material as to contain a linear diorganopolysiloxane for a main component, and have a viscosity of 100 centipoises or higher at 25° C.

The liquid silicone rubber material may be blended with various fillers, and pigment, a heat resistive agent, fire retardant, a plasticizer, an adhesion imparting agent, as needed, in order to adjust its flowability in such a range as not to impair the objects of the present invention or to improve the mechanical strength of a cured substance.

A stock solution of an additive reaction type of a liquid silicone rubber used in the present invention was a material suitable for achieving desired roller hardness after having been blended with an acicular filler, which was selected among liquid silicone rubbers of a grade containing no heat conductive filler, in an industrially available range.

3-2-2) Subsequently, a base polymer is blended with an acicular filler according to the present invention. The acicular fillers can be blended by weighing the predetermined quantity of a base polymer and the acicular filler, and dispersing the acicular fillers into the base polymer with a well-known filler mixing and stirring means such as a planet-style universal stirrer and a three rolls mill.

3-2-3) Subsequently, the above described silicone rubber material is cured by heat and formed on a core metal 24*a* into a roller. Means and a method for heat-curing and forming the roller are not limited, but a simple and preferred method for forming the roller is a method of mounting a metallic core 24*a* in a pipe mold having a predetermined internal diameter, filling the mold with the silicone rubber material, and heating the mold.

Here, a heating temperature is satisfactorily in a range of 70 to 200° C., and preferably of 70 to 150° C.; and a heating period of time is satisfactorily in a range of 5 minutes to 5 hours, and preferably of 10 minutes to 1 hour. The selected heat curing temperature and period of time are also the control settings peculiar to an apparatus and a mold, which can be freely and optimally set as long as there is substantially no problem with a curing reaction in an elastic layer and the adhesion of the elastic layer.

3-2-4) An elastic layer is subjected to the second heating for stabilizing physical properties of the elastic layer after having been cured, which aims at removing a reaction residue and an unreacted low molecule existing in the elastic layer of a silicone rubber. Here, an adequate temperature is in the range of 150 to 280° C., preferably 200 to 250° C.; and the heating period of time is satisfactorily in a range of 1 to 8 hours, and preferably of 2 to 4 hours. The selected heat curing temperature and period of time are also control settings peculiar to a selected material at the time, which can be optimally set into such an extent that physical properties mainly after having been cured become stable.

3-2-5) As a final step, a releasing layer 24*c* which is a tube made of a fluororesin, is layered on the above described elastic layer 24*b* with the use of an adhesive primer to be integrated with the elastic layer 24*b*. Here again a heating step is performed to cure the adhesive primer. The releasing layer is not necessarily formed in the final step, but can be formed with an own optimal method on the basis of a well known means.

(4) Evaluation

Various pressure rollers 24 as described in the following example rollers 1 to 6 and comparative example rollers 1 to 4 were prepared, and their various performances were evaluated. The comparative example rollers 1 to 4 are conventional pressure rollers.

The following various example rollers 1 to 6 and comparative example rollers 1 to 4 were prepared by using a core metal 24*a* made of an iron material with the diameter of 22 mm, forming an elastic layer 24*b* with the thickness of 4 mm, and forming the product of the pressure rollers 24 with the major diameter of 30 mm. In addition, a used tube was made from PFA and had the thickness of 30 μm.

4-1) Example Roller 1

An example roller 1 of a pressure roller 24 was prepared in the following way.

A stock solution of an additive reaction type liquid silicone rubber (an S component) was mixed with a filler (an F component) of acicular pitch based carbon fiber having the heating conductivity of 300 W/mK, the minor axis length of 9 μm and the major axis length of 500 μm so that a ratio of the mixed F component can become 12 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, an example roller 1 was obtained which is a pressurizing member according to the present invention.

The example roller 1 had the thermal conductivity λ of 0.5 W/mK and the roller hardness Hs of 40 degrees.

4-2) Example Roller 2

An example roller 2 of a pressure roller 24 was prepared in the following way.

A stock solution of an additive reaction type liquid silicone rubber (an S component) was mixed with a filler (an F component) of acicular pitch based carbon fiber having the heating conductivity of 900 W/mK, the minor axis length of 9 μm and the major axis length of 100 μm so that a ratio of the mixed F component can become 24 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, an example roller 2 was obtained which is a pressurizing member according to the present invention.

The example roller 2 had the thermal conductivity λ of 1.0 W/mK and the roller hardness Hs of 65 degrees.

4-3) Example Roller 3

An example roller 3 of a pressure roller 24 was prepared in the following way.

A stock solution of an additive reaction type liquid silicone rubber (an S component) was mixed with a filler (an F component) of acicular pitch based carbon fiber having the heating conductivity of 900 W/mK, the minor axis length of 9 μm and the major axis length of 150 μm so that a ratio of the mixed F component can become 15 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, an example roller 3 was obtained which is a pressurizing member according to the present invention.

The example roller 3 had the thermal conductivity λ of 0.6 W/mK and the roller hardness Hs of 56 degrees.

4-4) Example Roller 4

An example roller 4 of a pressure roller 24 was prepared in the following way.

A stock solution of an additive reaction type liquid silicone rubber (an S component) was mixed with a filler (an F component) of acicular pitch based carbon fiber having the heating conductivity of 900 W/mK, the minor axis length of 9 μm and the major axis length of 150 μm so that a ratio of the mixed F component can become 20 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, an example roller 4 was obtained which is a pressurizing member according to the present invention.

The example roller 4 had the thermal conductivity λ of 0.8 W/mK and the roller hardness Hs of 42 degrees.

4-5) Example Roller 5

An example roller 5 of a pressure roller 24 was prepared in the following way.

A stock solution of an additive reaction type liquid silicone rubber (an S component) was mixed with a filler (an F component) of acicular pitch based carbon fiber having the heating conductivity of 900 W/mK, the minor axis length of 9 μm and the major axis length of 150 μm so that a ratio of the mixed F component can become 26 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, an example roller 5 was obtained which is a pressurizing member according to the present invention.

The example roller 5 had the thermal conductivity λ of 1.2 W/mK and the roller hardness Hs of 60 degrees.

4-6) Example Roller 6

An example roller 6 of a pressure roller 24 was prepared in the following way.

A stock solution of an additive reaction type liquid silicone rubber (an S component) was mixed with a filler (an F component) of acicular pitch based carbon fiber having the heating conductivity of 900 W/mK, the minor axis length of 9 μm and the major axis length of 150 μm so that a ratio of the mixed F component can become 25 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, an example roller 6 was obtained which is a pressure roll 24 according to the present invention.

The example roller 6 had the thermal conductivity λ of 1.1 W/mK and the roller hardness Hs of 57 degrees.

4-7) Comparative Example Roller 1

A comparative example roller 1 of a pressure roller 24 was prepared in the following way.

A stock solution of an additive reaction type liquid silicone rubber (an S component) was mixed with a filler (an F component) of spherical alumina (with the average particle diameter of 11 μm) having the thermal conductivity of 36 W/mK so that a ratio of the mixed F component can become 52 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, a comparative example roller 1 was obtained.

The comparative example roller 1 had the thermal conductivity λ of 1.2 W/mK and the roller hardness Hs of 76 degrees.

For reference purposes, it is noted that the silicone rubber for a base having an extremely lower hardness than those used in the example rollers 1 to 6 was used here, but still showed high roller hardness, as was described above.

4-8) Comparative Example Roller 2

A comparative example roller 2 of a pressure roller 24 was prepared in the following way.

A stock solution of an additive reaction type liquid silicone rubber (an S component) was mixed with a filler (an F component) of spherical alumina (with the average particle diameter of 11 μm) having the thermal conductivity of 36 W/mK so that a ratio of the mixed F component can become 24 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μ. Thus, a comparative example roller 2 was obtained.

The comparative example roller 2 had the thermal conductivity λ of 0.3 W/mK and the roller hardness Hs of 40 degrees.

For reference purposes, it is noted that the silicone rubber for a base having an extremely lower hardness than those used in the example rollers 1 to 6 was used here, and barely achieved the above described hardness.

4-9) Comparative Example Roller 3

A comparative example roller 3 of a pressure roller 24 was prepared in the following way.

A stock solution of an additive reaction type liquid silicone rubber (an S component) was mixed with a filler (an F component) of spherical alumina (with the average particle diameter of 11 μm) having the thermal conductivity of 36 W/mK so that a ratio of the mixed F component can become 40 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, a comparative example roller 3 was obtained.

The comparative example roller 3 had the thermal conductivity λ of 0.7 W/mK and the roller hardness Hs of 68 degrees.

4-10) Comparative Example Roller 4

A comparative example roller 4 of a pressure roller 24 was prepared in the following way.

A stock solution of an additive reaction type liquid silicone rubber (an S component) was mixed with a filler (an F component) of a fine powder of pulverized quartz (with the average particle diameter of 5 μm) having the thermal conductivity of 10 W/mK so that a ratio of the mixed F component can become 15 vol. %, and the mixture was formed into an elastic layer 24*b* on a core metal 24*a*. Then, a releasing layer 24*c* was formed on the elastic layer 24*b* with the use of a PFA fluororesin tube having the thickness of 30 μm. Thus, a comparative example roller 4 was obtained.

The comparative example roller 4 had the thermal conductivity λ of 0.3 W/mK and the roller hardness Hs of 53 degrees.

4-11) Evaluations 1 to 4

The above described example rollers 1 to 6 and comparative example rollers 1 to 4 were subjected to evaluations 1 to 4.

4-11-1) Evaluation 1

A pressure roller temperature: after the heating temperature of a heater (a control temperature) was set to 190° C., and 500 sheets of paper with a longitudinal size of A4 (64 g/mm$^2$) were continuously passed through the rollers at the speed of 30 sheets/minute, the temperature at a no-paper-passing part of the pressure roller was measured.

4-11-2) Evaluation 2

A hardness decrease of a pressure roller: after the heating temperature of a heater was set to 190° C., and 150,000 sheets of paper with a longitudinal size of A4 (64 g/mm$^2$) were continuously passed through the rollers at the speed of 30 sheets/minute, the hardness decrease and the state of the rubber at a temperature risen portion of a no-paper-passing part of the pressure roller was evaluated.

4-11-3) Evaluation 3

A high-temperature offset: after the heating temperature of a heater was set to 190° C., 500 sheets of paper with the longitudinal size of A4 (64 g/mm$^2$) were continuously passed through the rollers at the speed of 30 sheets/minute, and then character patterns were printed on the paper with the longitudinal size of A3 (64 g/mm$^2$), the high-temperature offset at the end part due to temperature rise at a no-paper-passing part was evaluated.

4-11-4) Evaluation 4

Fixability: after the heating temperature of a heater was set to 190° C., and character patterns were printed on a cardboard rough paper Fox River Bond (90 g/mm$^2$), the fixed condition of a toner onto the paper was evaluated with a predetermined abrasion testing machine.

Here, an example roller 1, an example roller 4 and a comparative example roller 2 had a low product hardness and a wide nip width, and consequently a heating temperature of the heater necessary for fixing the toner was actually 170° C., so that the above described evaluations 1 to 4 were carried out at the heating temperature of 170° C. on the heater.

The evaluation results of the above described evaluations 1 to 4 on the example rollers 1 to 6 and the comparative example rollers 1 to 4 which are conventional pressure rollers are shown in Table 1.

TABLE 1

| | | | Example roller | | | | | | Comparative example roller | | | |
|---|---|---|---|---|---|---|---|---|---|---|---|---|
| | | | 1 | 2 | 3 | 4 | 5 | 6 | 1 | 2 | 3 | 4 |
| Roller characteristics | Roller hardness (Asker C) | ° | 40 | 65 | 56 | 42 | 60 | 57 | 76 | 40 | 68 | 53 |
| | Roller thermal conductivity | W/mk | 0.5 | 1.0 | 0.6 | 0.8 | 1.2 | 1.1 | 1.2 | 0.3 | 0.7 | 0.3 |
| Filler characteristics | filler | | Pitch base carbon fiber | Pitch base carbon fiber | Pitch base carbon fiber | Pitch base carbon fiber | Pitch base carbon fiber | Pitch base carbon fiber | Spherical alumina | Spherical alumina | Spherical alumina | Pulverized quartz |
| | Filler (F component) | vol % | 12 | 24 | 15 | 20 | 26 | 25 | 52 | 24 | 40 | 15 |
| | Thermal conductivity of filler (F component) | W/mk | 300 | 900 | 900 | 900 | 900 | 900 | 36 | 36 | 36 | 10 |
| | Filler length (minor axis/major axis) | μm | 9/500 | 9/100 | 9/150 | 9/150 | 9/150 | 9/150 | 11 | 11 | 11 | 5 |
| Evaluation 1 | Pressure roller temperature | | 210° C. | 196° C. | 212° C. | 200° C. | 195° C. | 199° C. | 182° C. | 213° C. | 198° C. | 220° C. |
| Evaluation 2 | Hardness decrease of pressure roller | | Δ 3° | Δ 1° | Δ 1.5° | Δ 2.6° | Δ 1.3° | Δ 1.5° | Fractured | Early fracture | Tube fold | Tube fold |
| Evaluation 3 | High-temperature offset | | ○ | ◎ | ○ | ◎ | ◎ | ◎ | ◎ | X | ○ | X X |
| Evaluation 4 | Fixability | | ◎ | ○ | ◎ | ◎ | ◎ | ◎ | X X | ◎ | X | ◎ |

It is understood in an evaluation 1 that a temperature at a no-paper-passing part of a pressure roller is generally proportionate to the thermal conductivity of the pressure roller. However, it is also understood from the comparison result of an example roller 5 with a comparative example roller 1 in Table 1 that both of the thermal conductivities of the two pressure rollers are 1.2 W/mK, but still the temperatures at no-paper-passing parts of the pressure rollers are different. This is because the hardness are different between the former and the later pressure rollers, and consequently nip widths in the moving direction of a recording material are different; and specifically because the example roller 5 has a lower hardness and consequently has a wider nip width than the comparative example roller 1 has, and receives more heat from a heater than the comparative example roller 1 does.

As described above, temperature at a no-paper-passing part of a pressure roller 24 has a relationship with thermal conductivity and the nip width of a pressure roller 24. In the example rollers 1 to 6, temperatures at a no-paper-passing part are controlled to 212° C. or lower, which inhibits occurrence of a high-temperature offset in an evaluation 4 that will be described later.

As for the hardness decrease of a pressure roller in an evaluation 2, the comparative example rollers 1 and 2 showed the fracture of rubber. As for the comparative example roller 1, the reason of the fracture of the rubber is considered to be because the used rubber had extremely low hardness though the temperature at a no-paper-passing part of the pressure roller was decreased by increasing the thermal conductivity of an elastic layer. As for the comparative example roller 2, the reason of the early fracture of the rubber is considered to be because the used rubber had extremely low hardness while the thermal conductivity of an elastic layer was kept low. The comparative example rollers 3 and 4 did not show the fracture of rubber, but showed the tube fold which is formed when rubber is considerably softened and deteriorated. The example rollers 1 to 6 did not show the fracture of rubber and tube fold, though having shown the decrease of the hardness in a practically allowable range. This is considered to be because the example rollers 1 to 6 used an acicular filler 24*d* having high heat conduction, which is the peculiarity of the rolls, and thereby could set the thermal conductivity of a pressure roller 24 to 0.5 W/mK or higher while using a rubber having a practical hardness.

As for a high-temperature offset in an evaluation 3, a comparative example roller 4 showed a very severe offset, and the comparative example roller 2 showed a rather severe offset. The example rollers 1 and 3 showed a very slight offset in such a level as not cause a practical problem, and the example rollers 4 to 6 and the comparative example rollers 1 and 3 did not show a high-temperature offset because the pressure roller 24 had a sufficiently high thermal conductivity. The reason why the comparative example roller 2 and the example roller 3 showed a different result on the high-temperature offset in spite of showing an approximately equal temperature of the pressure roller in an evaluation 1 can be attributed to the difference between heat radiation amounts during idle running (reverse rotation) which occurs when paper with the size of A4 was changed to paper with the size of A3 for the evaluation, and in which a main body and heating by a heater are stopped, or equivalently, to the difference of the thermal conductivity between the pressure rollers 24.

From the above description, it is understood that the thermal conductivity $\lambda$ of a pressure roller is preferably 0.5 W/mK or higher, and further preferably 0.8 W/mK or higher.

As for fixability in an evaluation 4, the comparative example roller 1 having extremely high hardness showed an extremely bad fixing failure, and the comparative example roller 3 having a high hardness beyond a practical range showed a bad fixing failure. In addition, the example roller 2 showed a slight fixing failure though practically causing no problem, and the example rollers 1, 3 to 6 and the comparative example rollers 2 and 4 showed an adequate fixability in a practical range.

This is because the rollers did not provide a necessary nip width for fixing a toner because their harnesses were too high, which implies that the product hardness is preferably 65 degrees or lower and further preferably 60 degrees or lower.

As is clear from the above description, a heat resistive rubber layer in the present embodiment has acicular fillers 24*d* having high thermal conductivity dispersed therein, which is the peculiarity of the present embodiment; enabled a pressure roller 24 to have the thermal conductivity set to 0.5 W/mK or higher and a product hardness set to 65 degrees or lower while employing a practical rubber, which could not be conventionally achieved; and consequently enabled the pressure roller 24 to acquire high thermal conduction and low hardness while maintaining the durability of the pressure roller 24, which is an object of the present invention. Hereby, an image-forming device having no problem with a temperature rise at a no-paper-passing part while maintaining the durability of a pressure roller 24 could be obtained.

Furthermore, an image-forming device having a higher resolution was obtained, because a pressure roller could have a thermal conductivity of 0.8 W/mK or higher and a product hardness of 60 degrees or lower.

In addition, it should be understood that an image-forming device can become adaptable to further speeding up because a pressure roller can acquire the thermal conductivity of 0.8 W/mK or higher and a product hardness of 60 degrees or lower.

(5) Others 5-1) In a heat fixing device 6 of a film-heating type in the above described embodiment, a heating body 22 is not limited to a ceramic heater. For instance, the heating body may be a contact-heating body using a nichrome wire, or an electromagnetic induction exothermic member such as a piece of a steel plate. The heating body 22 is not necessarily located in a fixing nip portion (a pressure-contacted nip portion).

A heating body 22 can be a film 23 itself if being made of an electromagnetic induction exothermic metallic film, which forms an electromagnetic induction thermal type of a heat fixing device.

A film 23 can be wound and stretched among a plurality of suspension members and rotationally driven by a driving roller, to be incorporated in the heat fixing device. In addition, the film 23 can be a long member having the ends, which is wound on a pay-off shaft and is traveled and moved to a take-up shaft side, to be incorporated in the heat fixing device.

5-2) A heating device is not limited to a film-heating type, but may be a heating roller type.

5-3) A heating device is not limited to a heat fixing device according to the embodiment, but may be an image heating apparatus which temporarily fixes an unfixed image, or an image heating apparatus which reheats a recording medium carrying the image to improve a surface nature such as gloss.

This application claims priority from Japanese Patent Application No. 2004-087747 filed Mar. 24, 2004, which is hereby incorporated by reference herein.

What is claimed is:

1. An image heating apparatus for heating an image formed on a recording material, comprising:

heating means for heating the image formed on the recording material;

a pressure roller for forming a nip portion in cooperation with said heating means, the recording material being conveyed in the nip portion;

wherein said pressure roller has a heat resistive rubber layer in which acicular fillers with a thermal conductivity of 300 W/mK or higher are dispersed in a rate of 12 to 26 volume percentage.

2. An image heating apparatus according to claim 1, wherein said acicular fillers have an average length of 100 to 500 μm.

3. An image heating apparatus according to claim 1, wherein said acicular fillers are pitch-based carbon fiber.

4. An image heating apparatus according to claim 1, wherein said heat resistive rubber layer is a silicone rubber layer.

5. An image heating apparatus according to claim 1, wherein said heating means has a heater and a flexible sleeve which rotates while making the inner circumferential surface contact with said heater, and the nip portion is formed by said heater and said pressure roller through said flexible sleeve.

6. An image heating apparatus for heating an image formed on a recording material, comprising:

heating means for heating the image formed on the recording material;

a pressure roller for forming a nip portion in cooperation with said heating means, the recording material being conveyed in the nip portion;

wherein said pressure roller has a thermal conductivity of 0.5 W/mK or higher and an Asker C hardness 65 degrees or lower.

7. An image heating apparatus according to claim 6, wherein said pressure roller has a heat resistive rubber layer in which acicular fillers with a thermal conductivity of 300 W/mK or higher are dispersed in a rate of 12 to 26 volume percentage.

8. An image heating apparatus according to claim 7, wherein said acicular fillers have an average length of 100 to 500 μm.

9. An image heating apparatus according to claim 7, wherein said acicular fillers are pitch-based carbon fiber.

10. An image heating apparatus according to claim 7, wherein said heat resistive rubber layer is a silicone rubber layer.

11. An image heating apparatus according to claim 6, wherein said heating means has a heater and a flexible sleeve which rotates while making the inner circumferential surface contact with said heater, and the nip portion is formed by said heater and said pressure roller through said flexible sleeve.

12. A pressure roller for being mounted on an image heating apparatus, wherein said pressure roller and a heating means form a nip portion to pinch and convey a recording material bearing an image, comprising:

a core metal having a roller shape; and a heat resistive rubber layer formed around said core metal;

wherein said pressure roller has a thermal conductivity of 0.5 W/mK or higher and an Asker C hardness of 65 degrees or lower, and wherein said heat resistive rubber layer contains acicular fillers with a thermal conductivity of 300 W/mK or higher dispersed in a rate of 12 to 26 volume percentage.

13. A pressure roller image according to claim 12, wherein said acicular fillers have an average length of 100 to 500 μm.

14. A pressure roller according to claim 12, wherein said acicular fillers are pitch-based carbon fiber.

15. A pressure roller according to claim 12, wherein said heat resistive rubber layer is a silicone rubber layer.

* * * * *

UNITED STATES PATENT AND TRADEMARK OFFICE

CERTIFICATE OF CORRECTION

PATENT NO. : 7,321,746 B2
APPLICATION NO. : 11/082858
DATED : January 22, 2008
INVENTOR(S) : Hiroyuki Sakakibara et al.

It is certified that error appears in the above-identified patent and that said Letters Patent is hereby corrected as shown below:

ON THE TITLE PAGE
At Item (56) Foreign Patent Documents, "05286056 A" should read --05-286056 A--.

COLUMN 2
Line 28, "provides" should read --provide--.

COLUMN 5
Line 60, "will" should read --will be--.

COLUMN 7
Line 30, "preventing" should read --prevent--.
Line 51, "layer" should read --layers--.

COLUMN 10
Line 2, "an" should read --its--.

COLUMN 11
Line 50, "roll" should read --roller--.

COLUMN 12
Line 19, "30 ì." should read --30ìm.--.

COLUMN 13
Table 1, the last 2 lines of the Table:

| | | | | | | | | | | | |
|---|---|---|---|---|---|---|---|---|---|---|---|
| Evaluation 3 | High-temperature offset | 0 | 0 | 0 | 0 | 0 | 0 | 0 | x | 0 | xx |
| Evaluation 4 | Fixability | 0 | 0 | 0 | 0 | 0 | 0 | xx | 0 | x | 0 |

should read:

| | | | | | | | | | | | |
|---|---|---|---|---|---|---|---|---|---|---|---|
| Evaluation 3 | High-temperature offset | 0 | ◎ | 0 | ◎ | ◎ | ◎ | ◎ | x | 0 | xx |
| Evaluation 4 | Fixability | ◎ | 0 | ◎ | ◎ | ◎ | ◎ | xx | ◎ | x | ◎ |

UNITED STATES PATENT AND TRADEMARK OFFICE

CERTIFICATE OF CORRECTION

PATENT NO. : 7,321,746 B2
APPLICATION NO. : 11/082858
DATED : January 22, 2008
INVENTOR(S) : Hiroyuki Sakakibara et al.

It is certified that error appears in the above-identified patent and that said Letters Patent is hereby corrected as shown below:

COLUMN 14
Line 7, “are” should read --is--.

COLUMN 15
Line 8, “not” should read --not to--.

COLUMN 16
Line 1, “contact-heating” should read --contact heating--.

COLUMN 18
Line 10, “pressure roller image” should read --pressure roller--.

Signed and Sealed this

Twenty-seventh Day of January, 2009

John Doll

JOHN DOLL
*Acting Director of the United States Patent and Trademark Office*